US011071391B2

(12) United States Patent
Decker et al.

(10) Patent No.: US 11,071,391 B2
(45) Date of Patent: Jul. 27, 2021

(54) CONVERTIBLE-COUCH WITH CONCEALED CONVENIENCE FEATURES

(71) Applicant: Textron Aviation Inc., Wichita, KS (US)

(72) Inventors: Jason Michael Decker, Wichita, KS (US); Nathan Earl Esau, Wichita, KS (US); Michael Scott Robinson, Wichita, KS (US); Christopher Adair Pinkerton, Derby, KS (US); David Michael Kuhn, Wichita, KS (US)

(73) Assignee: Textron Innovations, Inc., Providence, RI (US)

( * ) Notice: Subject to any disclaimer, the term of this patent is extended or adjusted under 35 U.S.C. 154(b) by 290 days.

(21) Appl. No.: 16/142,742

(22) Filed: Sep. 26, 2018

(65) Prior Publication Data

US 2019/0099005 A1 Apr. 4, 2019

Related U.S. Application Data

(60) Provisional application No. 62/567,818, filed on Oct. 4, 2017.

(51) Int. Cl.

| | |
|---|---|
| ***A47C 17/213*** | (2006.01) |
| ***A47C 17/16*** | (2006.01) |
| ***A47C 7/62*** | (2006.01) |
| ***A47C 17/175*** | (2006.01) |
| ***A47C 21/00*** | (2006.01) |

(52) U.S. Cl.

CPC ..... *A47C 17/213* (2013.01); *A47C 7/624* (2018.08); *A47C 7/628* (2018.08); *A47C 17/161* (2013.01); *A47C 17/1753* (2013.01); *A47C 21/003* (2013.01)

(58) Field of Classification Search

CPC . A47C 17/213; A47C 17/1753; A47C 21/003; A47C 17/161; A47C 7/628; A47C 19/22; A47C 17/86; A47C 17/225; B64D 11/0636

See application file for complete search history.

(56) References Cited

U.S. PATENT DOCUMENTS

| | | | | |
|---|---|---|---|---|
| 5,335,962 | A | 8/1994 | Gera | |
| 6,050,638 | A | 4/2000 | West, III | |
| 6,588,837 | B1 * | 7/2003 | Schultz | A47C 17/165 297/111 |
| 8,789,884 | B1 | 7/2014 | Edelman et al. | |
| 8,888,175 | B2 * | 11/2014 | Dobrusin | B64D 11/06 297/63 |

(Continued)

*Primary Examiner* — David R Hare
*Assistant Examiner* — Madison Emanski
(74) *Attorney, Agent, or Firm* — Erise IP, P.A.

(57) ABSTRACT

A convertible couch with concealed storage includes an upper seat back, a seat bottom adapted for sliding inwardly for a first mode and sliding outwardly for a second mode, and an articulating seat section between the upper seat back and the seat bottom. The articulating seat section converts between a lower seat back in the first mode and an inner seat bottom in the second mode. The first mode is adapted for seating and the second mode is adapted for lying and reclining. A storage location housing convenience features is located behind the articulating section, such that the storage location and convenience features are concealed in the first mode and accessible in the second mode.

14 Claims, 6 Drawing Sheets

(56) References Cited

U.S. PATENT DOCUMENTS

| | | | | |
|---|---|---|---|---|
| 9,390,571 | B1 | 7/2016 | Kupfer | |
| 10,499,745 | B2 * | 12/2019 | Adams | A47C 17/04 |
| 2002/0014795 | A1 * | 2/2002 | Williams | A47C 1/023 297/337 |
| 2008/0185887 | A1 * | 8/2008 | Merensky | B61D 31/00 297/217.3 |
| 2008/0236452 | A1 * | 10/2008 | Pratt | A47C 20/027 108/13 |
| 2015/0076872 | A1 * | 3/2015 | Carithers | A47C 7/62 297/182 |
| 2016/0046240 | A1 | 2/2016 | Lara sandoval et al. | |
| 2016/0278533 | A1 * | 9/2016 | Rox | A47C 17/04 |
| 2017/0303690 | A1 * | 10/2017 | King | A47C 7/40 |

* cited by examiner

CONVERTIBLE-COUCH WITH CONCEALED CONVENIENCE FEATURES

CROSS-REFERENCE TO RELATED APPLICATIONS

This application claims the benefit of U.S. Provisional Patent Application Ser. No. 62/567,818 entitled Convertible-Couch with Concealed Convenience Features and filed Oct. 4, 2017, the disclosure of which is herein incorporated by reference in its entirety.

BACKGROUND

1. Field of the Disclosure

Embodiments of this disclosure relate generally to multi-purpose seating arrangements. More specifically, a convertible couch-bed arrangement is configured to reveal hidden storage, lighting, electrical-power receptacles, and other convenience features.

2. Description of the Related Art

Many types of seats have storage compartments which have been described in the prior art. For example, U.S. Pat. No. 5,335,962 to Gera discloses a sectional sofa having a wedge section that forms a wedge table and a table segment on top of the wedge table that may be opened to reveal a storage area. U.S. Pat. No. 6,050,638 to West discloses a couch with a secured compartment located beneath the seat cushions. U.S. Pat. No. 8,789,884 to Edelman et al. discloses an outdoor chaise lounge with an integrated lock box. U.S. Pat. No. 9,390,571 to Kupfer discloses a chair with storage and charging capabilities. U.S. Patent Publication 2016/0046240 to Lara sandoval et al. discloses a seat assembly with embedded and hidden storage.

SUMMARY

In an embodiment, a convertible couch is provided. The convertible couch includes an upper seat back, a seat bottom adapted for sliding inwardly for a first mode and sliding outwardly for a second mode, an articulating section between the upper seat back and the seat bottom for articulating between alignment with the upper seat back in the first mode and alignment with the seat bottom in the second mode, and convenience features located behind the articulating section, such that the convenience features are concealed in the first mode and the convenience features are accessible in the second mode.

In another embodiment, a convertible couch with concealed storage is provided. The convertible couch includes an articulating seat section that converts between a lower seat back in a first mode and an inner seat bottom in a second mode. The first mode is adapted for seating and the second mode is adapted for lying and reclining. The convertible couch further includes a storage location concealed behind the articulating section in the first mode that becomes accessible in the second mode.

BRIEF DESCRIPTION OF THE DRAWINGS

Illustrative embodiments of the present disclosure are described in detail below with reference to the attached drawing figures, which are incorporated by reference herein and wherein.

DETAILED DESCRIPTION

Embodiments of the present disclosure provide features concealed within a couch. The couch converts between a first arrangement for seating and a second arrangement conducive to reclining and lying down. The concealed features include lights, cup holders, storage compartments, and electrical-power receptacles. Upon certain modes of conversion, the concealed features are revealed making them accessible to a user for the purpose of improved comfort, convenience and entertainment.

Figure 1:
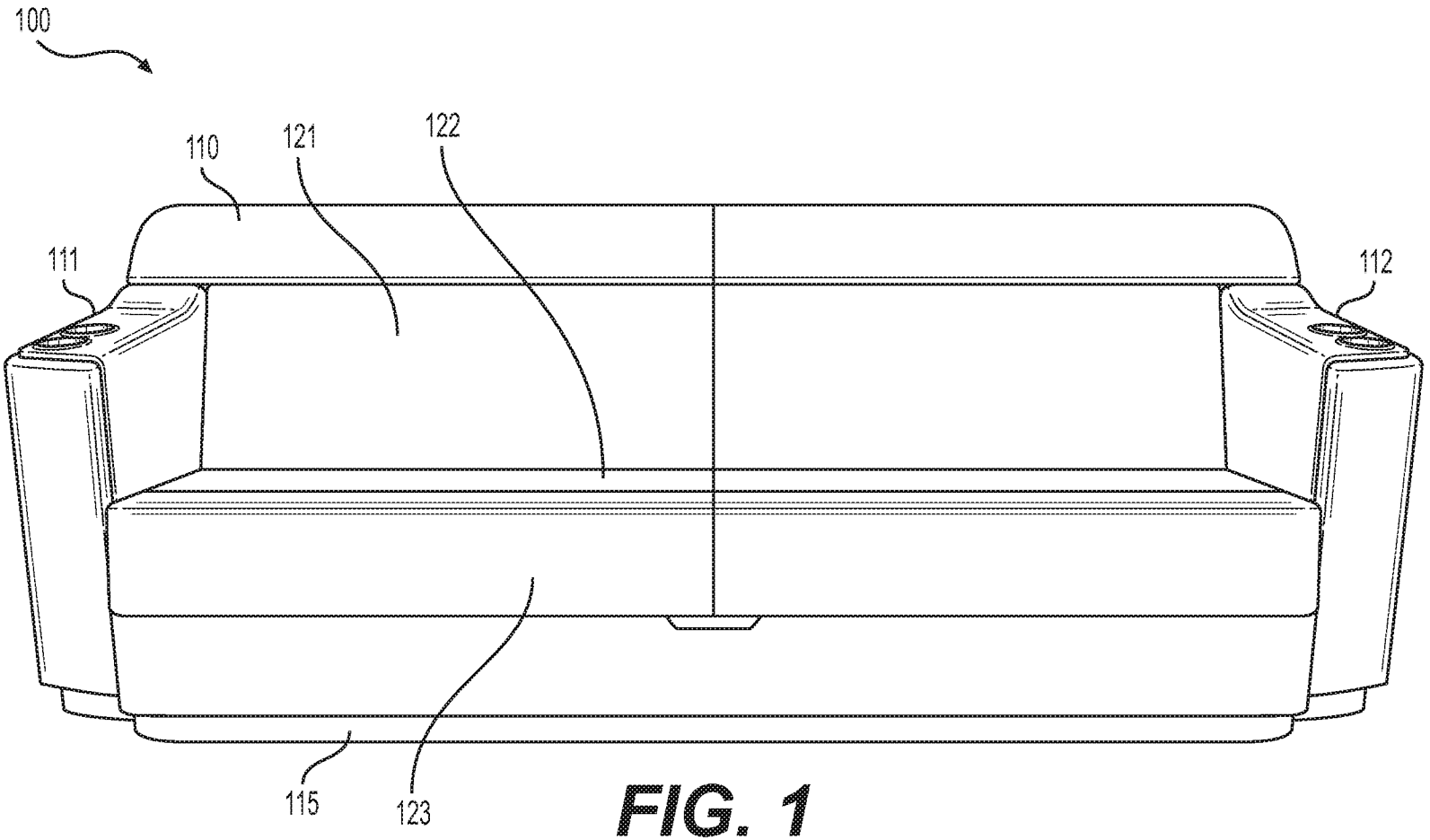
FIG. 1 is a forward-facing view of a convertible couch configured for seating, in an embodiment.

FIG. 1 is a forward-facing view of an exemplary convertible couch 100 configured for seating. Convertible couch 100 includes three seating sections having cushions and underlying support structures (not shown) that enable movement as described below. A first seat section 121 is an articulating portion that forms at least a part of a seat back when convertible couch 100 is configured as depicted in FIG. 1. A seat bottom includes a second seat section 122 adjacent the first seating section 121, and a third seat section 123 adjacent the second seating section 122. A base 115 is located beneath at least third seat section 123 to provide support. In certain embodiments, first seat section 121 is configured to articulate downward and forward while second and third seat sections 122, 123 simultaneously slide forward such that first seat section 121 lies substantially flat and adjacent to second seat section, as depicted in FIGS. 2 and 3.

Returning to FIG. 1, an upper seat back 110 extends longitudinally across couch 100 above and adjacent to first seat section 121. In other words, upper seat back 110 is oriented horizontally and spans the couch lengthwise in a longitudinal direction. A first armrest 111 and a second armrest 112 flank opposing ends of convertible couch 100 and extend transversely from upper seat back 110. In other words, first and second armrests are oriented in a transverse direction that is substantially perpendicular to the longitudinal direction. First and second armrest 111, 112 may include built-in features such as electrical-power receptacles, control pads, and one or more cup holders, for example. As depicted in FIG. 1, the first mode provides a seating mode in which couch 100 is configured for one or more users to sit upright (e.g., with a user's back against first seat section 121 and feet able to rest on the floor).

Figure 2:
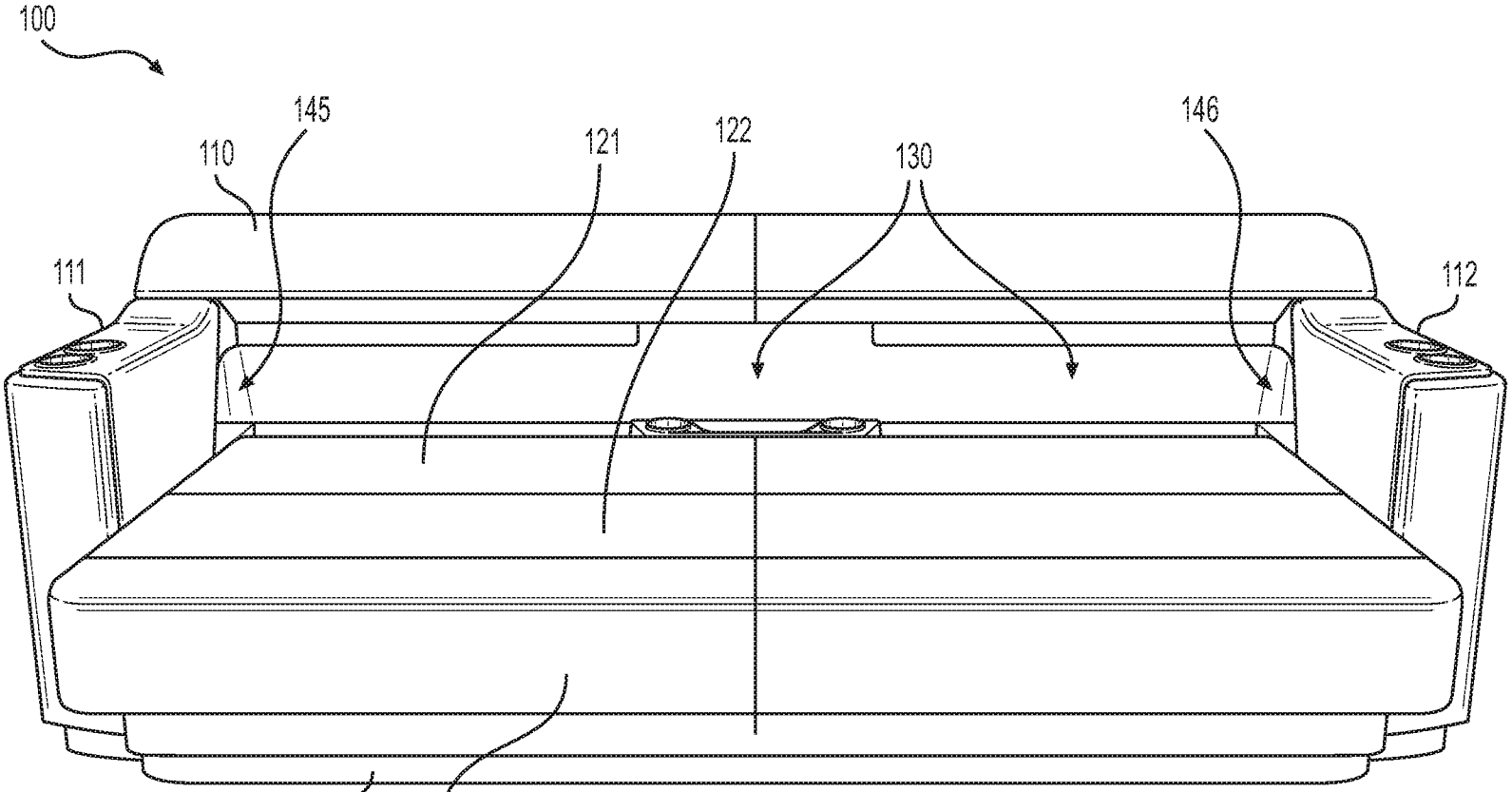
FIG. 2 is a forward-facing view of the convertible couch of FIG. 1 configured for lying and reclining and revealing convenience features, in an embodiment.
Figure 3:
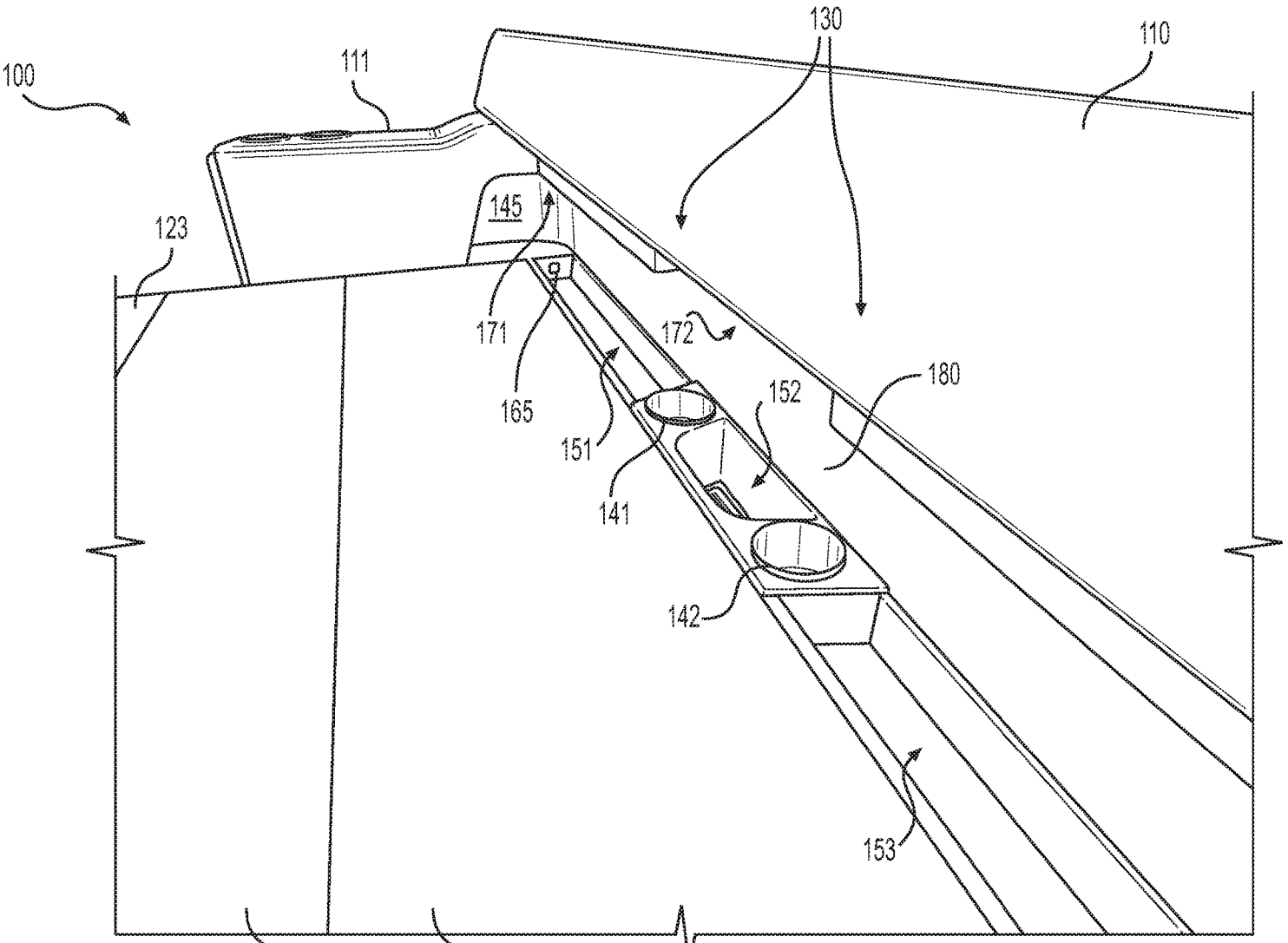
FIG. 3 is a perspective view of the convertible couch of FIG. 2 showing the convenience features.

In operation, convertible couch 100 converts between the first mode for seating, as depicted in FIG. 1, and a second mode for reclining/lying, as depicted in FIG. 2. Upon conversion from the first mode to the second mode, base 115 slides forward in the transverse direction with seat section 123 to maintain its position beneath seat section 123. In other words, base 115 is slidable (e.g., with rollers that roll along rails mounted to the floor) and when seat section 123 extends outwardly beyond armrests 111, 112, base 115 supports an outer section of the seat bottom (e.g., seat section 123). In contrast, upper seat back 110 remains stationary in both the first mode and the second mode. A detailed description of the mechanical components underpinning the articulating and sliding motions for conversion of convertible couch 100 between the first mode and the second mode is fully described in a related U.S. Nonprovisional application Ser. No. 16/055,339, entitled Modular Seat, filed on Aug. 6, 2018, which is herein incorporated by reference in its entirety.

FIG. 2 is a forward-facing view of the convertible couch 100 positioned in the second mode for reclining/lying. The second mode is marked by first, second, and third seat sections 121, 122, 123, lying substantially flat. A width of substantially flat cushions is wider in the second mode making couch 100 more comfortable for reclining and sleeping compared to the first mode. While reclining, a user may place his or her feet on top of the seat sections 121, 122, 123 and face sideways. The user may lean back against either of first or second armrests 111, 112 or against upper seat back 110. Alternatively, the user may lie down (e.g., for sleeping). In some embodiments, the second mode provides a wide enough flat section for more than one user to assume a more relaxed position for reclining, lounging or lying down.

The second mode enables the user to gain access to a storage location housing convenience features 130 that are otherwise concealed and inaccessible in the first mode. As depicted in FIG. 2, example convenience features 130 include a first cubby 145 and a second cubby 146, which are located behind first armrest 111 and second armrest 112, respectively. First and second cubbies 145, 146 provide small storage compartments that are hidden behind and beneath first and second armrests 111, 112 from a view facing convertible couch 100 (e.g., the view provided in FIG. 2). First and second cubbies 145, 146 are hidden when couch 100 is in the first mode and accessible when couch 100 is in the second mode. In certain embodiments, convertible couch is a side-facing couch onboard an aircraft that converts between a couch for seating and a bed for reclining and sleeping.

FIG. 3 is a perspective view of the convertible couch of FIG. 2 showing convenience features 130. Convenience features 130 include a first recessed light 171 that is used to illuminate a first cubby 145, and a first Universal Serial Bus (USB) port 165 that is provided for charging small electronic devices. In certain embodiments, a standard electrical outlet (e.g., 110V) is also provided (not shown). A first trough 151, a second trough 152, and a third trough 153 are each aligned beneath upper seat back 110. The opening of first, second, and third troughs 151, 152, 153 are adjacent a top surface of first seat section 121 such that the depth of the trough extends beneath the top surface of first seat section 121.

A first cup holder 141 and a second cup holder 142 are configured for receiving cups or mugs and storing the cups or mugs upright. In the embodiment depicted in FIG. 3, the cup holders and troughs are arranged symmetrically such that first cup holder 141 is located between first and second troughs 151, 152, and second cup holder 142 is positioned between second and third troughs 152, 153. First and second cup holders 141, 142 are accessible for users seated in a reclined position (e.g., leaning back against either first armrest 111 or second armrest 112, respectively).

A second recessed light 172 may be used to provide additional lighting of for example, first and second cup holders 141, 142 and second trough 152. However, in certain embodiments, other quantities and arrangements of cup holders, recessed lights, electrical-power receptacles and troughs may be used without departing from the scope hereof. A back surface 180 may be configured for reflecting light and/or adding ambiance. In certain embodiments, back surface 180 is a wood-veneer surface that may provide a partial reflection under certain lighting conditions.

Figure 4:
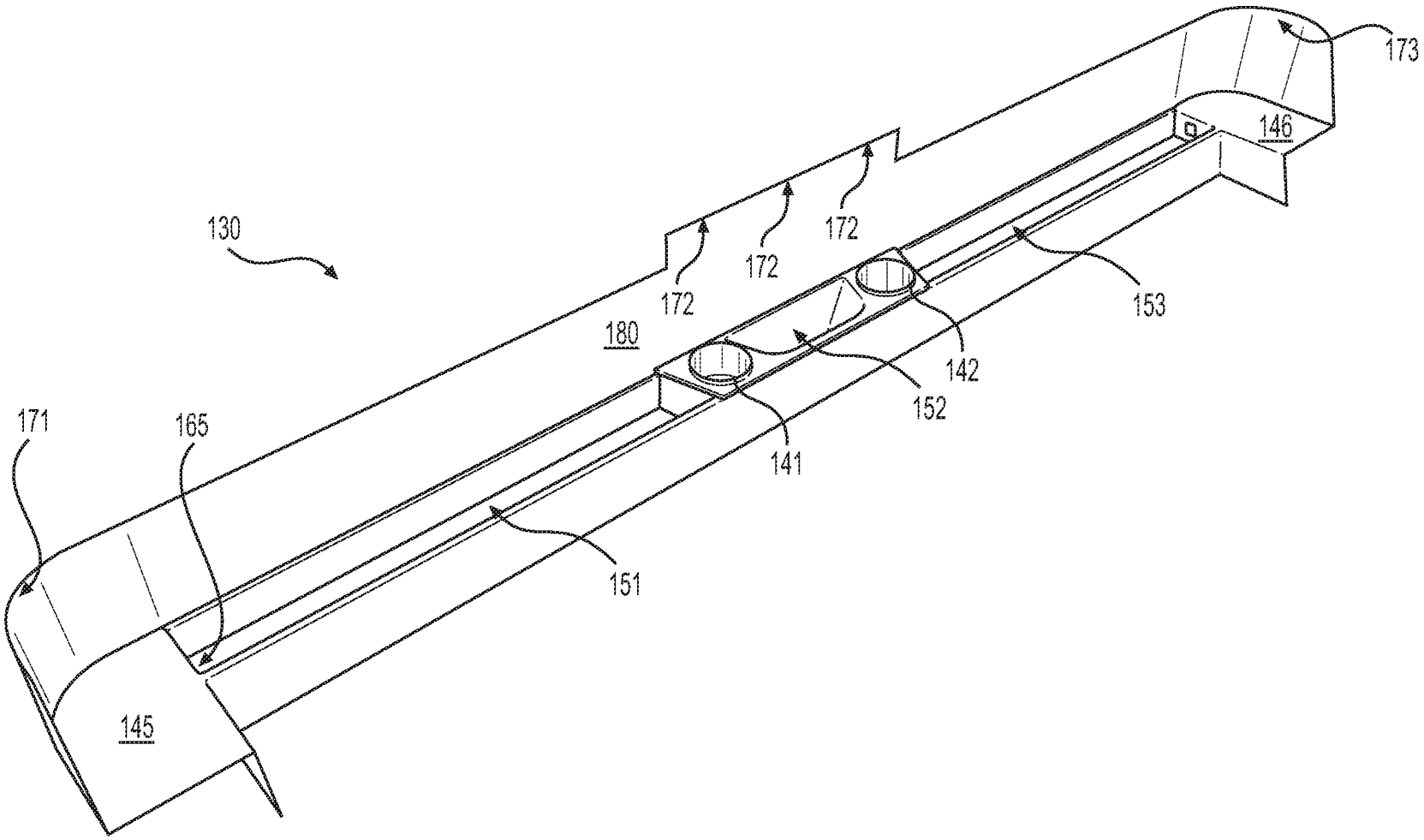
FIG. 4 is a perspective view of the convenience features of FIGS. 2 and 3, in an embodiment.

FIG. 4 is a perspective view of convenience features 130 of FIGS. 2 and 3. A second cubby 146 is adjacent third trough 153 and behind second armrest 112 (not shown in FIG. 4). A third recessed light 173 is used to illuminate second cubby 146. A second USB port 166 is located in the end of third trough 153, opposite first USB port 165. In certain embodiments, first and second USB ports 165, 166 may each include a plurality of USB ports. For example, each of first and second USB ports 165, 166 may include two vertically positioned USB ports ideal for charging phones or media devices. In some embodiments, the USB ports enable connection of a mobile device to an onboard computer for controlling aircraft cabin features, such as lighting, temperature control, and for coupling with a speaker system (e.g., to play music).

In certain embodiments, first, second, and third recessed lights 171, 172, 173 provide accent lighting that contribute to the ambiance of the space surrounding convertible couch 100. In some embodiments, first, second, and third recessed lights 171, 172, 173 provide a downwash lighting. Each of first, second, and third recessed lights 171, 172, 173 may include more than one light such as a series or array of LEDs (e.g., an array of LEDs mounted to a printed circuit board). In addition to recessed lights, additional lighting may be provided. For example, portable or adjustable lighting (e.g., gooseneck task lighting) may be stored in first and second cubbies 145, 146 and retrieved by a user for reading or illuminating other tasks.

Figure 5:
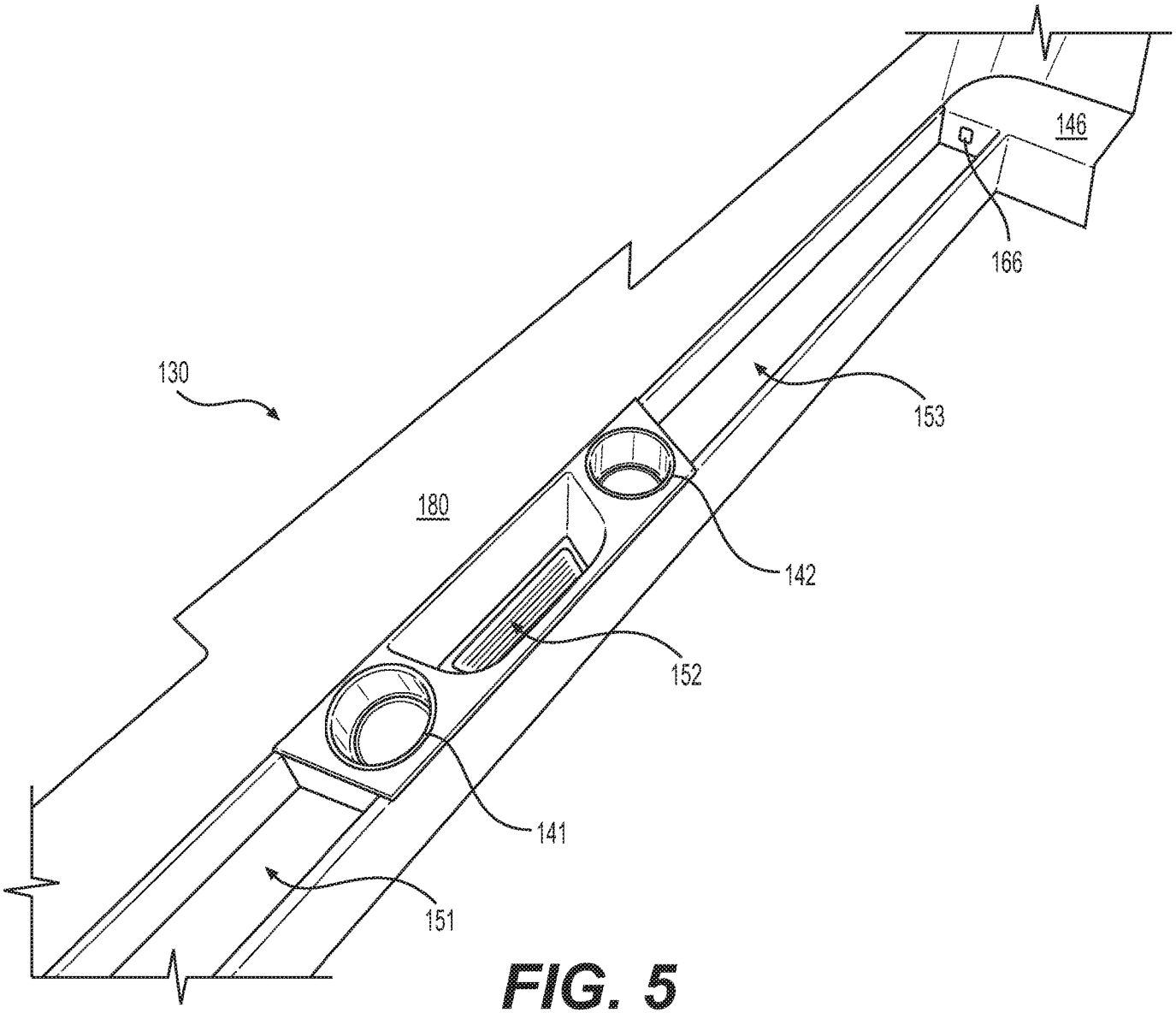
FIG. 5 is a perspective view of some of the convenience features of FIG. 4.
Figure 6:
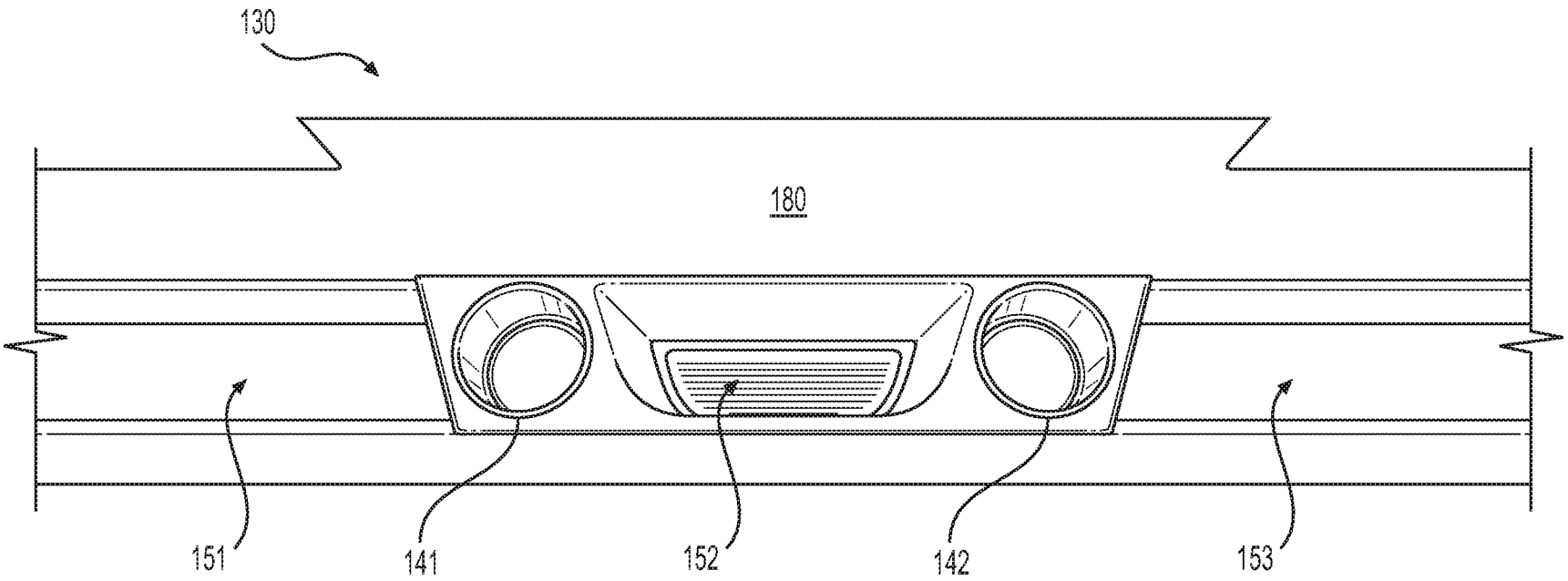
FIG. 6 is a top-down view of some of the convenience features of FIGS. 4 and 5.

FIG. 5 is another perspective view of convenience features 130 of FIG. 4. FIG. 6 is a top-down view of a central portion of convenience features 130 of FIG. 4. In some embodiments, second trough 152 has a water-proof and easy to clean liner conducive to accepting food and drinks. Along the bottom of second trough 152, the liner surface may include grooves to reduce items from sliding within second trough 152 (e.g., due to aircraft movements). In certain embodiments, the liner surface at the bottom of second trough 152 is a rubber mat insert. The bottom of first and second cup holders 141, 142 may also include a grooved or patterned liner for gripping the underside of cups and mugs. In certain embodiments, first and third trough 151, 153 have a non-scratch and non-slippery bottom liner (e.g., a leather mat insert) conducive to accepting small personal items (e.g., phones, watches, jewelry).

Convenience features 130 enable users to enjoy a personalized space dedicated to entertainment and comfort. Convertible couch 100 may be particularly advantageous for passengers during extended travels (e.g., onboard aircraft during long flights).

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all operations listed in the various figures need be carried out in the specific order described.

The invention claimed is:

1. A convertible couch, comprising:

a seat back having a stationary upper portion and a moveable lower portion;

the moveable lower portion of the seat back is configured for articulating between an upright orientation in alignment with the stationary upper portion in a first mode and a substantially horizontal orientation in a second mode;

the stationary upper portion extends longitudinally across the convertible couch in both the first mode and the second mode;

a seat bottom disposed adjacent the moveable lower portion, the seat bottom being adapted for sliding inwardly for the first mode and sliding outwardly for the second mode;

at least one armrest that extends from beneath the stationary upper portion adjacent the moveable lower portion;

a first storage compartment located behind the moveable lower portion, wherein the first storage compartment houses convenience features such that the convenience features are concealed by the moveable lower portion in the first mode and the convenience features are accessible in the second mode; and a second storage compartment located within the at least one armrest, such that the moveable lower portion is configured to conceal the second storage compartment in the first mode but not in the second mode.

2. The convertible couch of claim 1, wherein the convenience features are selected from the group consisting of a cup holder, an electrical-power receptacle, a light, or a trough.

3. The convertible couch of claim 1, further comprising a forward base beneath an outer portion of the seat bottom for sliding inwardly for the first mode and sliding outwardly for the second mode to support the outer portion of the seat bottom in both the first mode and the second mode.

4. The convertible couch of claim 1, further comprising at least one trough aligned behind and beneath the moveable lower portion, the at least one trough having a non-scratch and non-slippery bottom liner.

5. The convertible couch of claim 1, further comprising at least one recessed light located on an underside of the stationary upper portion of the seat back, the at least one recessed light adapted to provide a downwash accent lighting.

6. The convertible couch of claim 5, further comprising a back surface beneath the stationary upper portion and behind the moveable lower portion, the back surface being partially reflected from the at least one recessed light.

7. A convertible couch with concealed storage, comprising:

a seat back having a lower back rest and an upper back rest;

an articulating seat section that converts between the lower back rest in a first mode and an inner seat bottom in a second mode, wherein the first mode is adapted for seating and the second mode is adapted for lying and reclining;

an upper back rest that extends longitudinally across the convertible couch above the articulating seat section, wherein the upper back rest remains stationary for a user to lean against in both the first mode and the second mode;

a storage compartment located beneath the upper back rest, such that the storage compartment is concealed behind the articulating seat section in the first mode and is accessible in the second mode; and the storage compartment having a first end and a second end, wherein the first end extends into the first arm rest and the second end extends into the second arm rest such that the first end and the second end are each concealed by the lower back rest in the first mode, and the first end and the second end are each fully accessible in the second mode.

8. The convertible couch of claim 7, further comprising a seat bottom that slides transversely for conversion between the first mode and the second mode.

9. The convertible couch of claim 7, wherein the seat bottom includes an inner section adjacent the articulating seat section and an outer section adjacent the inner section.

10. The convertible couch of claim 9, further comprising a slidable seat base beneath the outer section of the seat bottom that supports the outer section of the seat bottom in both the first mode and the second mode.

11. The convertible couch of claim 7, further comprising a first arm rest extending transversely from beneath a first end of the upper back rest and a second arm rest extending transversely from beneath a second end of the upper back rest, opposite the first end.

12. The convertible couch of claim 7, wherein the upper back rest comprises:

a downwardly facing underside; and one or more lights recessed within the downwardly facing underside for illuminating the storage compartment.

13. The convertible couch of claim 7, wherein the storage compartment includes one or more electrical outlets for charging mobile devices.

14. The convertible couch of claim 7, wherein the storage compartment includes one or more cup holders for holding cups upright.

* * * * *